US008033962B2

(12) United States Patent
Veitch

(10) Patent No.: US 8,033,962 B2
(45) Date of Patent: Oct. 11, 2011

(54) SKIPPING ROPE

(76) Inventor: Rupert Simon Veitch, Elsternwick (AU)

( * ) Notice: Subject to any disclaimer, the term of this patent is extended or adjusted under 35 U.S.C. 154(b) by 0 days.

(21) Appl. No.: 12/392,109

(22) Filed: Feb. 25, 2009

(65) Prior Publication Data

US 2010/0216608 A1 Aug. 26, 2010

(51) Int. Cl.
*A63B 5/22* (2006.01)
*A63B 5/20* (2006.01)

(52) U.S. Cl. ..... 482/81; 482/82

(58) Field of Classification Search ..... 482/81, 482/82, 126; 446/307; D21/672
See application file for complete search history.

(56) References Cited

U.S. PATENT DOCUMENTS 4,201,382 A * 5/1980 Wilson ..... 482/82
4,489,934 A * 12/1984 Miller ..... 482/82
4,801,137 A * 1/1989 Douglass ..... 482/82
5,054,772 A * 10/1991 Winston ..... 482/82
5,224,910 A * 7/1993 Deutsch ..... 482/82
5,445,586 A * 8/1995 Yun ..... 482/82
5,746,687 A * 5/1998 Vial et al. ..... 482/126
5,749,812 A * 5/1998 Feciura et al. ..... 482/82
5,842,956 A * 12/1998 Strachan ..... 482/82
6,551,222 B1 * 4/2003 Beaver ..... 482/82
6,595,900 B1 * 7/2003 Cook ..... 482/82
6,672,997 B1 * 1/2004 Winkler ..... 482/126
7,628,735 B1 * 12/2009 Hsu ..... 482/82
7,740,570 B2 * 6/2010 Winston ..... 482/121
2003/0148859 A1 * 8/2003 Chun ..... 482/82
2008/0287273 A1 * 11/2008 Ma ..... 482/108

* cited by examiner

*Primary Examiner* — Loan Thanh
*Assistant Examiner* — Sundhara M Ganesan
(74) *Attorney, Agent, or Firm* — Stites & Harbison PLLC; Douglas E. Jackson

(57) ABSTRACT

This invention is a skipping rope comprising a flexible cord and a pair of handles secured on the cord and defining there between an effective cord length wherein at least one of the said handles on the cord is an interference fit in the opening of the handle so the effective cord length is adjusted by moving the handle assembly along the cord member and is maintained by the interference fit between the cord and the opening in the handle. Movement of the handle is performed simply by applying tension between the cord and the handle so the user, by moving the handle in one direction or the other, may find an effective working cord length that most suits them.

5 Claims, 3 Drawing Sheets

SKIPPING ROPE

FIELD OF THE INVENTION

The present invention provides an improved skipping rope, of the type used for exercise and recreation.

BACKGROUND

The skipping rope is among the oldest and simplest devices used for maintaining fitness and co-ordination. Maintaining fitness is now considered very important and desirable by many people.

Although skipping ropes for exercise have been developed to offer improved speed, comfort and durability, users still experience problems such as kinking and tangling of the rope, especially when the rope is packed tight in packaging or a container.

It is important that a skipping rope be of a length suited to each individual user, and therefore it is desirable to provide for precise, easy and reliable adjustability.

The skipping rope provided by the present invention addresses these problems.

SUMMARY OF THE INVENTION

In this specification the terms "skipping rope" and "skipping rope assembly" are used interchangeably.

The invention provides a skipping rope assembly comprising two handles and a flexible elongate element secured to each handle so as to define an effective length there between, wherein the elongate element is an interference fit in an opening in a said handle such that (a) the effective length is adjustable by movement of the flexible elongate element through the opening; and (b) the effective length is subsequently maintained by the interference fit in use of the skipping rope for skipping.

It is preferred that at least that portion of the flexible elongate element that has an interference fit in said handle comprises a resilient flexible elastomeric material. Such a material can resist kinking and tangling and lends itself well to the use of an interference fit to provide adjustability of the effective length.

In particular, at least that portion of the flexible elongate element that has an interference fit in said handle may comprise an externally fabric braided elastomeric cord. Such material is commercially available and sometimes referred to as "shock cord".

In a preferred embodiment, said opening is an opening in either:

(a) an inner race of a rolling element bearing comprised in said handle; or (b) a sleeve secured within an inner race of a rolling element bearing comprised in said handle For ease of adjustment of its effective length, the skipping rope assembly may be characterized in that:

(a) said handle is elongate and said opening is at a first end of said handle; and (b) said flexible elongate element extends lengthwise in said handle from said opening and out through a further opening at an end of said handle opposite to said first end so that an end of said elongate flexible element is external to said handle.

Everywhere in this specification, the word "comprise" and such derivatives as "comprises", "comprising", and "comprised", where used in relation to a set of items, integers, features or steps is to be taken to mean that those items, integers, features or steps are present, but without precluding the possibility that other items, integers, features or steps are also present.

BRIEF DESCRIPTION OF THE DIAGRAMS

FIG. 1 is a perspective view of a skipping rope according to the invention;

FIG. 2*a* is a perspective view of inner ends of handles of the skipping rope shown in FIG. 1;

FIG. 2*b* is a perspective view of outer ends of handles of the skipping rope shown in FIG. 1;

FIG. 2*c* is a perspective view of one handle and a portion of the rope part of the skipping rope shown in FIG. 1, in the process of being adjusted;

DETAILED DESCRIPTION OF PREFERRED EMBODIMENTS

Figure 1:
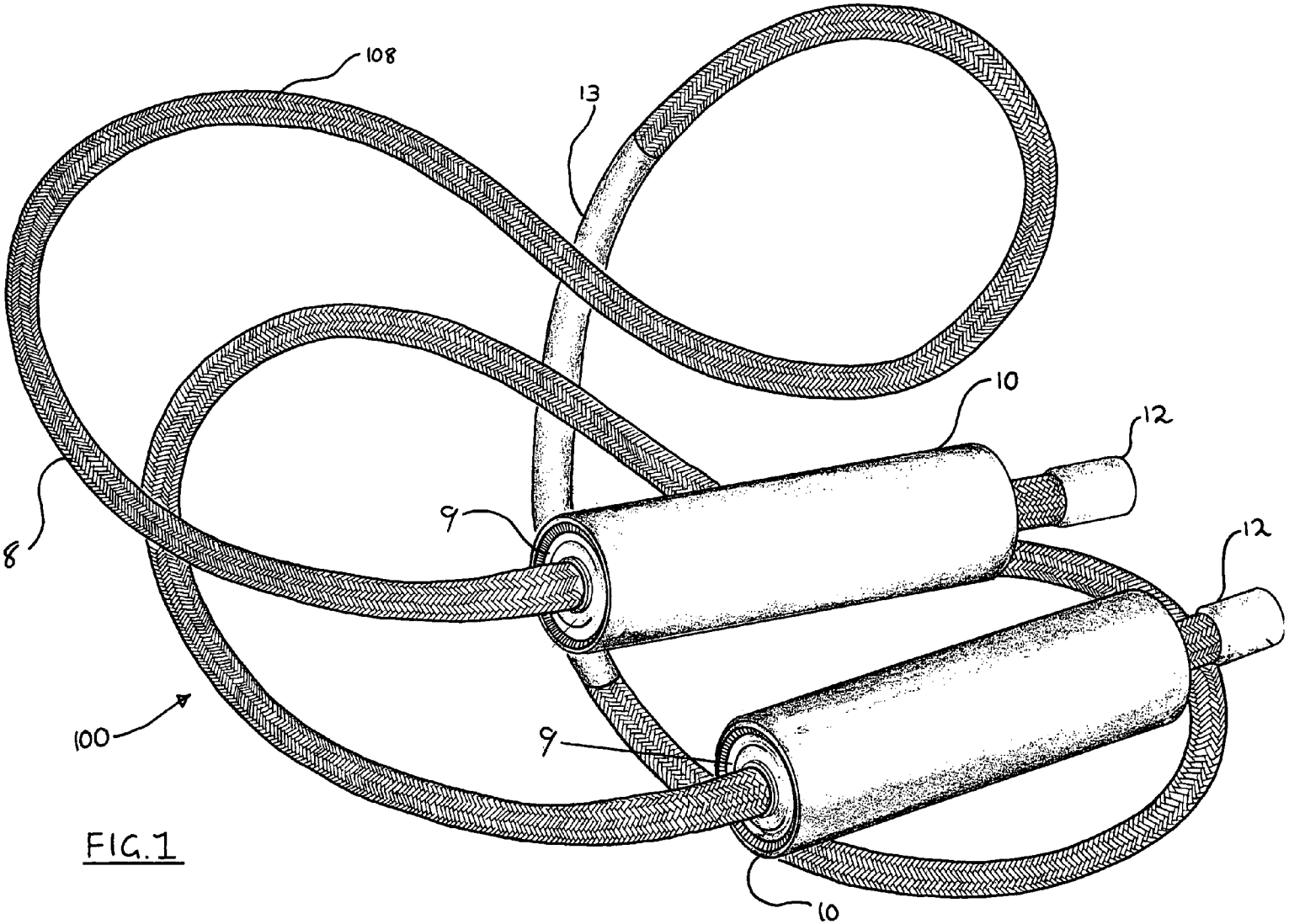

FIG. 1 shows a skipping rope 100 according to the invention. Skipping rope 100 comprises an elongate flexible element 8 and secured thereon two handles 10. Skipping rope 100 is used by a user (not shown) gripping one of the handles 10 in each hand and rapidly rotating that portion of the flexible element 8 about a line (not explicitly shown) between the handles 10 so that it forms a half loop between handles 10 that repeatedly passes over the user's head and under his or her feet. For maximum life of the skipping rope 10, a length of heat-shrink plastics tubing 13 is provided on flexible element 8 halfway along its length. In use of skipping rope 100, it is normal for the flexible element to brush the ground or floor surface (not shown) when passing beneath the user's feet, and plastics tubing 13 is positioned to contact the ground or floor surface and so prevent wear of the flexible element 8. Tubing 13 is optional and is not of the essence of the invention.

In order to avoid problems of kinking and tangling of flexible element 8, it has been found successful to form flexible element 8 from a resilient material that avoids or resists the tendency of some materials to retain a bend or kink that is imposed on it and this is done in the skipping rope 100. A suitable choice has been found to be a cord formed from rubber or a rubberlike elastomeric material. Cord of this type is widely available and is typically provided with a fabric braid 108 on its outer surface. It is sometimes referred to as "shock cord", and is widely used for securing small loads on vehicles and for similar applications. It has been found that such material works satisfactorily both when the skipping rope is tightly packed in a small container before sale and subsequently, when for example it is hung up for storage. Surprisingly, the use of such resilient material offers a further advantage in allowing for an easy way of adjusting the length of flexible element 8 between the handles 10 and for subsequently maintaining that adjustment until it is required to change the adjustment. This is now described by reference to FIGS. 2*a*, 2*b*, 2*c* and 3 which show a representative one of handles 10. (Although it is not essential that the two handles 10 be identical, it is preferred that they are.)

Flexible element 8 passes lengthwise through each of handles 10, which are positioned on opposite sides of the length of tubing 13, near ends of flexible element 8. An end fitting 12 is firmly secured (as described later) to each end of flexible element 8, each end fitting 12 being on the opposite side of its associated handle 10 from the length of flexible element 8 that extends between handles 10. As shown in the longitudinal cross-sectional view of FIG. 3 and the detail view of FIG. 4, flexible element 8 extends through handle 10, passing axially through a ball race 9 having an internal diameter D2 that is less than the diameter D1 of the flexible element 8. D2 and D1 and the material of flexible element 8 are so chosen that flexible element 8 can be pulled lengthwise through ball race 9 to adjust the length of flexible element 8 between the handles 10 due to the compressibility of flexible element 8 and will then maintain its position due to flexible element 8 being an interference fit in ball race 9. As flexible element 8 is resilient, any part of its length that passes through ball race 9 springs resiliently back to its normal diameter D1.

Figure 2B:
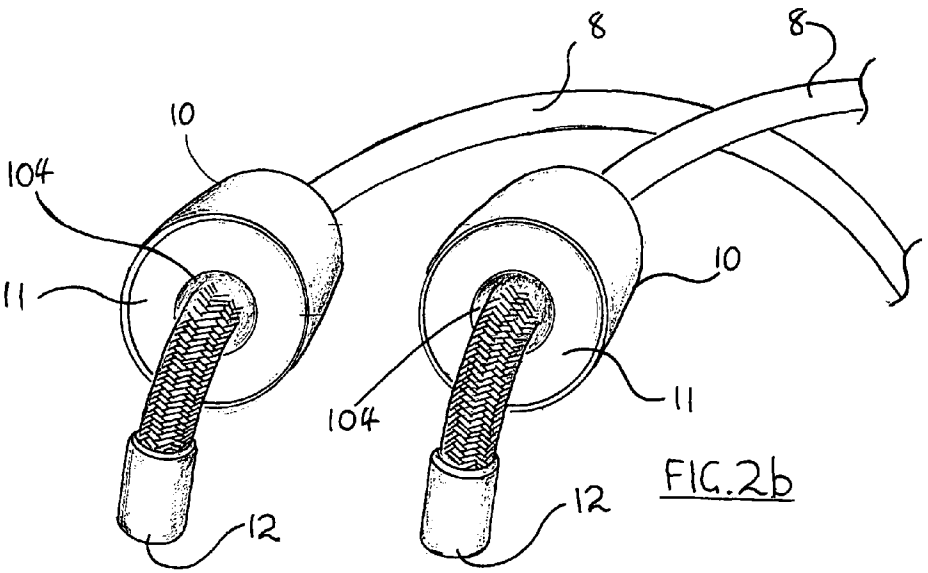
Figure 2A:
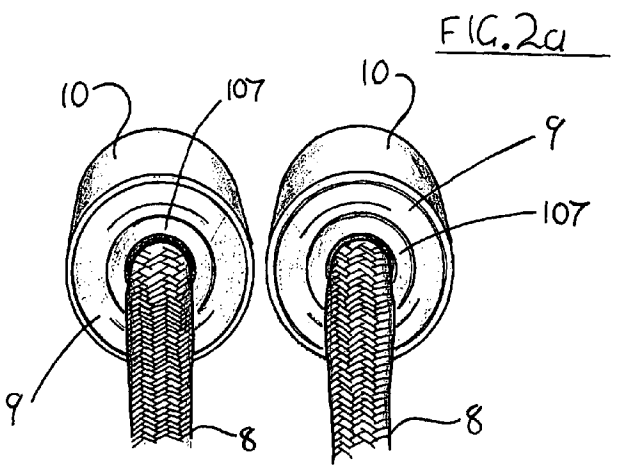
Figure 2C:
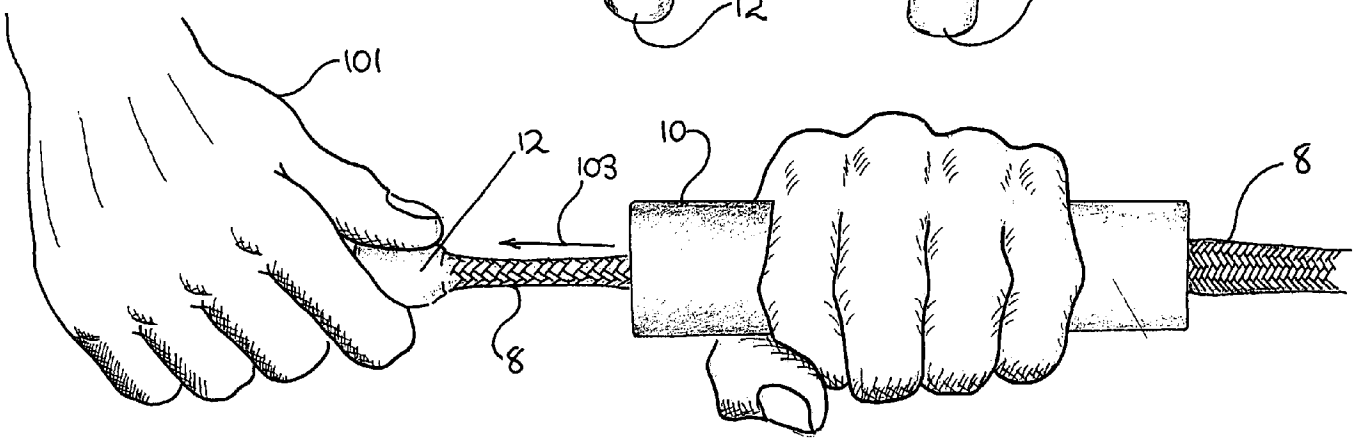

FIG. 2*c* shows a user's hand 101 pulling on end fitting 12 to pull flexible element 8 through handle 10 (held by a second hand 102) in the direction shown by arrow 103 to shorten the length of flexible element 8 between handle 10 and the other handle 10 (not shown). Of course, the length between handles 10 can be increased by gripping flexible element 8 on the side remote from end fitting 12 and pulling it in the opposite direction through handle 10. Such an adjustment method has been found quick, easy and convenient. A fine degree of length adjustment can be readily obtained. A bush 11 is provided in handle 10 at the end opposite the ball race 9, with flexible element 8 passing through a hole 104 therein, to avoid excessive freeplay of flexible element 8 within handle 10. Bush 11 is preferred, but optional.

Having the length adjustment capability as described above is particularly preferred if an anti-wear portion is provided in flexible element 8, such as the length of tubing 13, as the length adjustment can be symmetrical about the anti-wear portion for correct balance of the portion of flexible element 8 between handles 10.

The adjustment facility described above is not dependent on the use of ball race 9. However, ball race 9 obviates the need for flexible element 8 to rotate about its own length during skipping, making for an easier skipping action.

Figure 3:
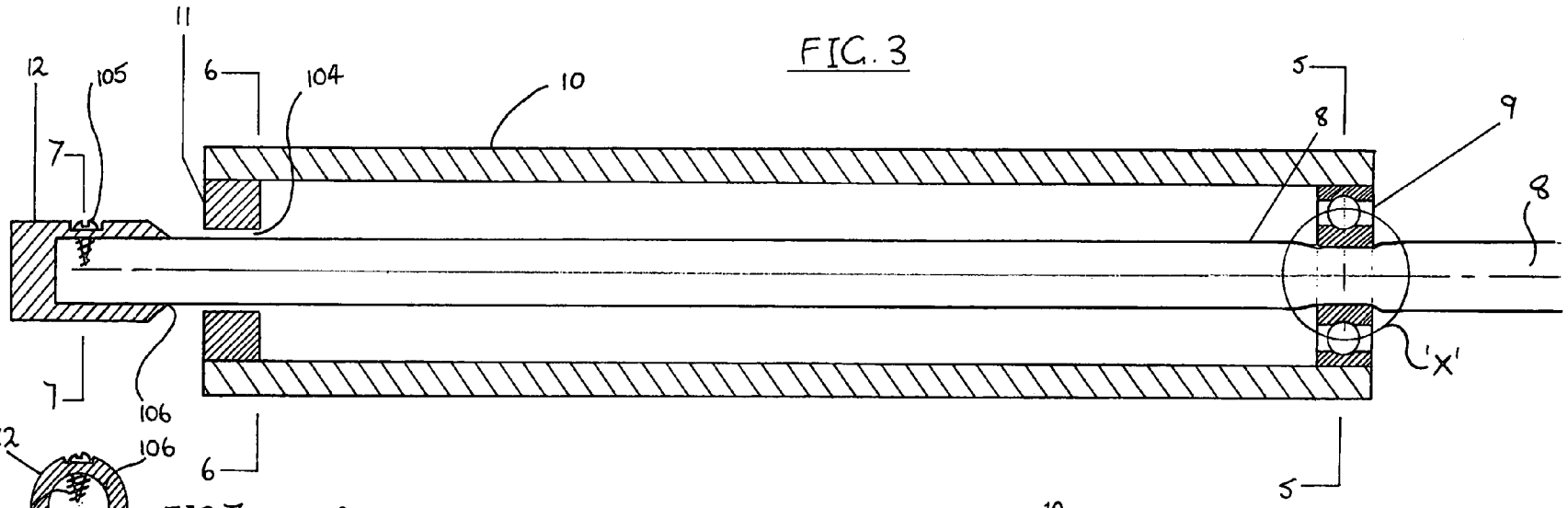
FIG. 3 is a longitudinal cross-sectional view of one handle of the skipping rope shown in FIG. 1.
Figure 4:
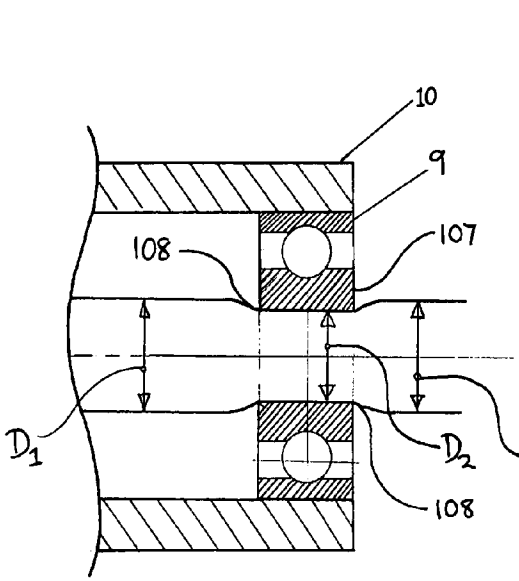
FIG. 4 is an enlargement of the section marked "X" from FIG. 3 showing a ball race.
Figure 5:
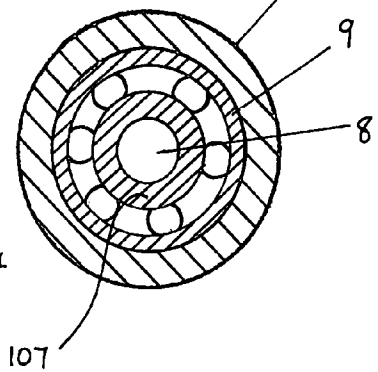
FIG. 5 is a cross-sectional view of the handle as shown in FIG. 3, the section being taken at station "5-5"
Figure 6:
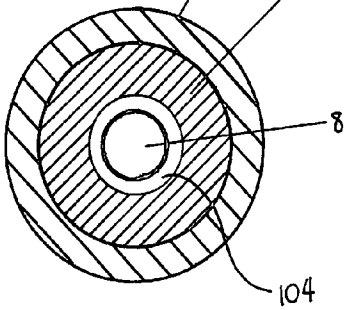
FIG. 6 is a cross-sectional view of the handle as shown in FIG. 3, the section being taken at station "6-6"
Figure 7:
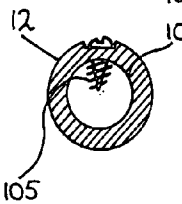
FIG. 7 is a cross-sectional view of a rope end fitting of the skipping rope as shown in FIG. 3, the section being taken at station "7-7".

End fitting 12 receives flexible element 8 in a recess 106 and is shown in FIGS. 3 and 7 as being secured to flexible element 8 by a screw 105 (although it will be apparent to persons skilled in the art that other perfectly satisfactory alternative methods could be used. Fitting 12 limits any tendency of fabric braiding on the end of element 8 to fray and prevents the end of element 8 unintentionally passing through hole 104 in bush 11.

In the Figures, element 8 has been shown as being an interference fit directly in the inner race 107 of ball race 9. Alternatively, however, a sleeve or grommet (not shown) could be provided to fit in, and be retained in, the inner race 107 and to bear on the outer surface of element 8. Such a sleeve could be contoured to avoid the comparatively sharp (i.e. small-radius) corners 108 of the inner race 107 and so minimize wear due to pulling of element 8 through ball race 9.

Although the element 8 has been described as a single length of a flexible and resilient material in the form of a rope or cord, element 8 may alternatively comprise multiple sections connected to each other end-to-end, provided the part or parts secured to a handle in the manner described above are of flexible resilient material and an interference fit in each handle. It is known for skipping ropes (not shown) to have a central section that is formed from a length of flexible and abrasion-resistant material with separate lengths of a flexible material secured to its ends. Those separate lengths could be of a resilient material, interference-fitted in the respective handles, to be within the scope of the present invention.

Other variations on the skipping rope as described above but within the scope of the invention, will readily suggest themselves to persons skilled in the art.

The claims defining the invention are as follow:

1. A skipping rope assembly comprising:

two handles, one of the handles having a through passage, a rolling element bearing provided in the one handle, the rolling element bearing having an inner race defining a central bearing opening aligned with the through passage in the one handle, the central bearing opening of the inner race alone defining a minimum cross sectional opening of the entire through passage of the one handle, a flexible elongate element having a) a first end which freely passes through the through passage in the one handle except for where the first end passes through the minimum cross sectional opening of the through passage defined by the central bearing opening of the rolling element bearing, and which first end rotates about the rolling element bearing, b) a second end which is secured to the other handle, and c) a length between the first and second ends which defines an effective skipping length between the two handles, and an interference fit between the first end of the flexible elongate element and the minimum cross sectional opening of the through passage defined by the central bearing opening, the interference fit a) having a holding strength which secures the first end of the flexible elongate element to the minimum cross sectional opening of the through passage defined by the central bearing opening and hence to the one handle during skipping, b) being defined by an element cross section of the flexible elongate element, said element cross section i) having a size which is greater than the minimum cross sectional opening of the through passage defined by the central bearing opening, and ii) being compressible in the minimum cross sectional opening of the through passage defined by the central bearing opening, the compressibility of the flexible elongate element in the minimum cross sectional opening of the through passage defined by the central bearing opening determining the holding strength of the interference fit between the minimum cross sectional opening of the through passage defined by the central bearing opening and the flexible elongate element, c) being operative to adjust the effective length of the flexible elongate element by pulling lengthwise of the flexible elongate element to overcome the holding strength and to move the first end relative to the minimum cross sectional opening of the through passage defined by the central bearing opening, and d) being operative to maintain the adjusted effective length of the flexible elongate element in use during skipping as the holding strength of the interference fit secures the flexible elongate element to the minimum cross sectional opening of the through passage defined by the central bearing opening in the one handle.

2. A skipping rope assembly according to claim 1 wherein at least that portion of the flexible elongate element that has an interference fit in said handle comprises a resilient flexible elastomeric material.

3. A skipping rope assembly according to claim 1 or 2 wherein at least that portion of the flexible elongate element that has an interference fit in said handle comprises an externally fabric braided elastomeric cord.

4. A skipping rope assembly according to claim 1 wherein:

(a) said one handle is elongate and said opening is at a first end of said one handle and a second opening is at an end of said one handle opposite to said first end; and (b) said flexible elongate element extends lengthwise in said one handle from said first-mentioned opening to extend out through said second opening so that an end of said elongate flexible element is external to said one handle.

5. A skipping rope assembly according to claim 1, wherein the other handle is the same as said one handle.

* * * * *